US009309727B2

(12) United States Patent
Birkeland

(10) Patent No.: US 9,309,727 B2
(45) Date of Patent: Apr. 12, 2016

(54) MOUSEHOLE APPARATUS

(75) Inventor: Roy Birkeland, Nodeland (NO)

(73) Assignee: Aker MH AS, Kristiansand (NO)

( * ) Notice: Subject to any disclaimer, the term of this patent is extended or adjusted under 35 U.S.C. 154(b) by 0 days.

(21) Appl. No.: 14/239,082

(22) PCT Filed: Aug. 16, 2012

(86) PCT No.: PCT/EP2012/066028
§ 371 (c)(1),
(2), (4) Date: Feb. 25, 2014

(87) PCT Pub. No.: WO2013/024139
PCT Pub. Date: Feb. 21, 2013

(65) Prior Publication Data

US 2014/0251686 A1 Sep. 11, 2014

(30) Foreign Application Priority Data

Aug. 17, 2011 (NO) ..... 20111133

(51) Int. Cl.
*E21B 19/00* (2006.01)
*E21B 7/12* (2006.01)
*E21B 19/14* (2006.01)

(52) U.S. Cl.
CPC ..... *E21B 19/002* (2013.01); *E21B 7/12* (2013.01); *E21B 19/14* (2013.01); *E21B 19/143* (2013.01)

(58) Field of Classification Search
None
See application file for complete search history.

(56) References Cited

U.S. PATENT DOCUMENTS

| | | | | |
|---|---|---|---|---|
| 3,981,369 | A * | 9/1976 | Bokenkamp | 175/5 |
| 4,647,014 | A * | 3/1987 | Ekman | B25J 18/025 254/221 |
| 5,468,121 | A | 11/1995 | Stogner | |
| 5,762,279 | A * | 6/1998 | Horton, III | E21B 19/02 254/285 |
| 6,209,851 | B1 * | 4/2001 | Eilertsen | B66D 3/04 166/77.51 |
| 7,677,856 | B2 * | 3/2010 | Standal | E21B 19/14 166/85.5 |
| 2005/0126792 | A1 | 6/2005 | Berry | |
| 2008/0304939 | A1 * | 12/2008 | Dekker | E21B 19/146 414/22.63 |

FOREIGN PATENT DOCUMENTS

| | | | |
|---|---|---|---|
| NO | 309537 | B1 | 2/2001 |
| NO | 20045263 | A | 6/2006 |
| NO | 322116 | B1 | 8/2006 |
| WO | WO 2007/043891 | A1 | 4/2007 |
| WO | WO 2011/083028 | A2 | 7/2011 |
| WO | WO 2012/061506 | A2 | 11/2011 |

OTHER PUBLICATIONS

TTS Sense AS: "TTS Sense AS Company Presentation", Open Oct. 23, 2010, Sep. 1, 2009, XP007922068, pp. 1-69.

* cited by examiner

*Primary Examiner* — Matthew R Buck
*Assistant Examiner* — Douglas S Wood
(74) *Attorney, Agent, or Firm* — Birch, Stewart, Kolasch & Birch, LLP

(57) ABSTRACT

A mousehole apparatus having a main body configured for holding a drill pipe or similar elongate element, includes a carrier connected to a deck structure and having a support region adapted for releasable supportive interaction with an abutment element on the main body. The carrier comprises guiding devices for the main body and movement means operable to move the main body with respect to the carrier.

15 Claims, 4 Drawing Sheets

MOUSEHOLE APPARATUS

FIELD OF THE INVENTION

The invention concerns a mousehole apparatus for holding a drill pipe or similar elongate element and a method of operating one or more mousehole apparatuses.

BACKGROUND OF THE INVENTION

In well drilling operations, joints of drill pipe are generally connected one after the other to the upper end of the drill string. Drill pipe joints are typically stored near the rig platform, from where they are retrieved, one by one, and placed in a vertical holding tube known as a "mousehole." The mousehole holds the joint in a vertical orientation, in preparation for connection for the drill string. The mousehole is typically positioned underneath the drill floor and has an opening in the drill floor, near region of the drill floor where drill pipe connection takes place. It is also well known to use a so-called "powered mousehole", which in fact is a mousehole with an elevating bottom, allowing for adjustment of the mousehole length (depth).

The state of the art includes U.S. Pat. No. 5,468,121, which discloses a mousehole installed underneath rig floor. The mousehole comprises a longitudinally oriented sleeve depending from the rig floor. The sleeve includes an open top end more or less flush with the rig floor, a closed bottom end, and a wall. Arranged at the bottom end of the mousehole is an expandable (inflatable) bladder which may be used for elevating the pipe joint in the mousehole. The mousehole disclosed in U.S. Pat. No. 5,468,121 also comprises a carriage disposed adjacent to the bottom end of the mousehole and which is operatively engaged by a hoist. The hoist includes a cable guided in a groove of a sheave mounted in the carriage. The cable is secured at one end to an outer surface of the sleeve by means such as a pad eye and looped through parallel slits formed longitudinally on opposite sides in the sleeve for engagement with the sheave. The other end of the cable is then attached to a reel of the hoist in the rig floor. When it is desired to elevate the pipe joint for raising its upper end above the rig floor, the hoist is activated to draw in or shorten the cable and, in turn, elevate the carriage within the mousehole.

A key factor in the design of mouseholes is of course the length of the tubular to be handled; this dictates the overall length of the mousehole. Mousehole lengths of 40 feet (12 meters) to 75 feet (23 meters) are common. The mousehole extends though the drill floor and into the space underneath the drill floor, above the cellar deck.

On a drilling rig, it is of utmost importance to have access to the entire cellar deck area. Of particular importance is the ability to move the overhead cranes. Such overhead are suspended from underneath the drill floor structure, above the cellar deck. State-of-the-art mouseholes, which are suspended from the drill floor deck, will interfere with the operation of crane(s) in the cellar deck area. Therefore, to ensure unimpeded crane movements above the cellar deck, the only solution is to disconnect all utilities, connect any external lifting device at the drill floor level, and pull them out. This is a troublesome, time consuming and in many cases a somewhat risky operation.

The present applicant has devised and embodied this invention in order to overcome these shortcomings and to obtain further advantages.

SUMMARY OF THE INVENTION

The invention is set forth and characterized in the main claim, while the dependent claims describe other characteristics of the invention.

It is thus provided a mousehole apparatus having a main body configured for holding a drill pipe or similar elongate element, characterized by a carrier connected to a deck structure and having a support region adapted for releasable supportive interaction with an abutment element on the main body, and wherein the carrier further comprises guiding devices for the main body and movement means operable to move the main body with respect to the carrier.

In one embodiment, the movement means is connected to the main body and is operable to move at least a portion of the main body from one side of the carrier to the opposite side of the carrier. The main body preferably comprises an elongate tubular element having an interaction member connectable to the movement means.

In one embodiment, the movement means comprises a first winch arranged on the carrier, a cable extending from the winch, via the interaction member and back to a second winch or fixture on the carrier.

In one embodiment, the interaction member is connected to a support device for the drill pipe or similar elongate element, and the support device is movably arranged within the main body, whereby the support device may be moved up and down in the main body by operating the first winch and/or (optionally) the second winch.

The mousehole apparatus comprises a locking device whereby the support device may be releasably fixed to the main body, whereby the main body may be moved up and down with respect to the carrier by operating the first winch and/or (optionally) the second winch.

The carrier is preferably movably arranged on the deck structure, which is connected to and arranged below a drill floor. In one embodiment, the mousehole apparatus comprises a compounded carrier supporting and controlling a plurality of main bodies.

It is also provided a method of operating one or more mousehole apparatuses according to the invention on a drilling vessel having a drill floor and a cellar deck arranged a distance below the drill floor, thus defining a cellar compartment there between, characterized by selectively moving the main body between a mousehole working position, in which the main body extends into the cellar compartment, and a mousehole inactive position, in which the main body is retracted from the cellar compartment.

In one embodiment, when in the mousehole working position, the main body is suspended from a carrier and the support device is movable within the main body.

In one embodiment, to bring the mousehole to an inactive position, the support device is locked to the main body, and movement means activated to retract the main body out of the cellar compartment.

It is also provided a drilling vessel having a drill floor and a cellar deck arranged a distance below the drill floor, thus defining a cellar compartment there between, characterized in that one or more of the mousehole apparatuses according to the invention are arranged on a deck structure which is arranged underneath—and connected to—the drill floor, and in that the main body is movable between an extended position into the cellar compartment, and a retracted position where the main body is retracted from the cellar compartment.

BRIEF DESCRIPTION OF THE DRAWINGS

These and other characteristics of the invention will be clear from the following description of a preferential form of embodiment, given as a non-restrictive example, with reference to the attached drawings wherein.

DETAILED DESCRIPTION OF A PREFERENTIAL EMBODIMENT

Figure 1:
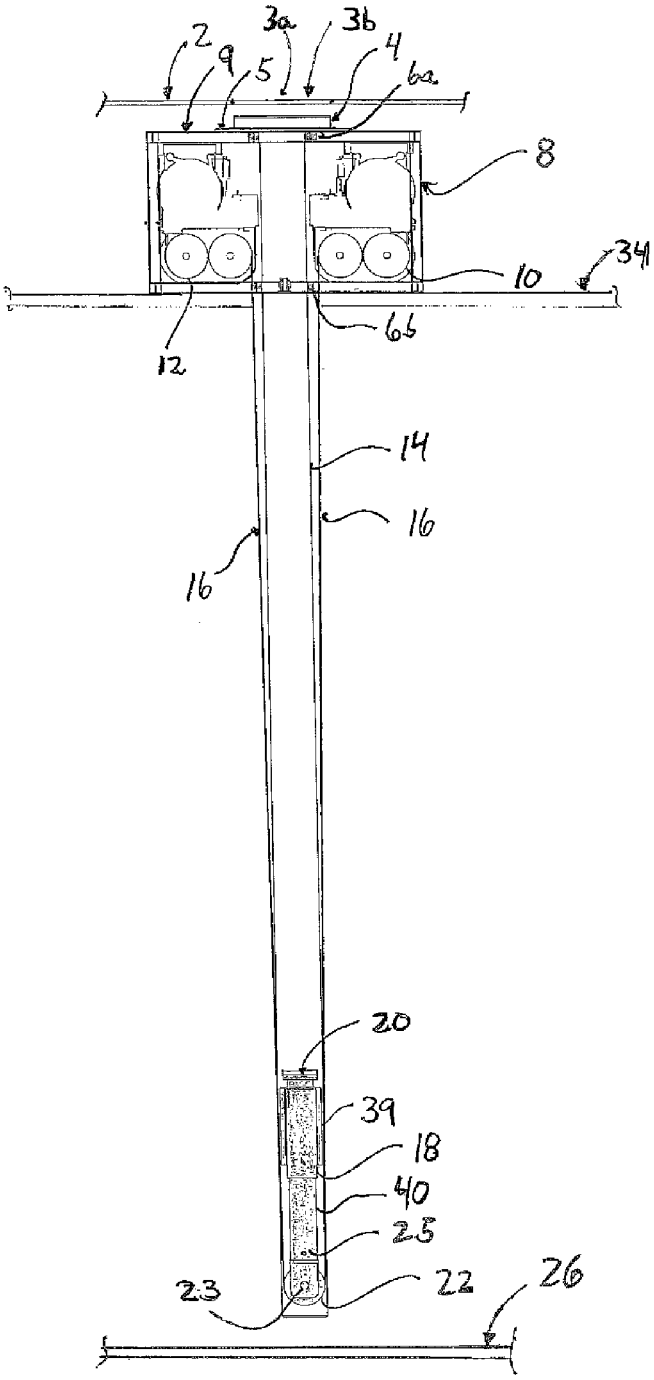
FIG. 1 is an elevation view and partly cut-away drawing of the retractable mousehole according to the invention, in an unlocked state and suspended from a drill floor.

FIG. 1 shows an embodiment of the invented mousehole apparatus installed in deck structure having a drill floor 2. A deck frame 8 is arranged on skid beams 34 (which in turn are attached to the deck structure), below the drill floor 2. Suspended by the deck frame is a mousehole tube 14. The mousehole tube extends through an upper guide 6*a* and a lower guide 6*b* in the deck frame, and is suspended via a support flange or collar 5 on the tube's upper end which bears against a region 9 of the deck frame's upper surface. The mousehole tube is thus slidably arranged in the deck frame. FIG. 1 shows the mousehole apparatus in a working position, i.e. hanging down from the deck frame 8 and extending into the space 38 between the drill floor and the cellar deck 26.

Inside the mousehole tube is an elevating bottom 18 (sometimes referred to as a "rabbit" and per se commonly known in the art), arranged and furnished with wheels or a synthetic material 39 so that it may move up and down within the tube. The elevating bottom 18 comprises a support face 20 for the drill pipe, and may conveniently also comprise a shock absorber 40.

A cable sheave 22 is rotatably connected to the elevating bottom (here: the lower portion) via a pin 23. A cable 16 extends from a winch 10 in the deck frame, down around the cable sheave 22 and back up to the deck frame where it is connected to a second winch 12. This second winch 12 is optional, inasmuch as the cable instead may be connected to a fixture (not shown) in the deck frame 8. The movement of the elevating bottom 18 inside the mousehole tube is thus controlled by the operation of the winch 10 and (optionally) the second winch 12. This is an arrangement for lifting and lowering the elevating bottom which per se is well known in the art. The upper end of the mousehole tube is furnished with a centralizer 4, and the drill floor comprises an opening 3*a* with a removable cover plate 3*b*. The centralizer 4 is designed to keep any size tubular within the specified range, at the centre of the mousehole tube.

Optionally, the lower part of the mousehole tube 14 may be fastened to the cellar deck 26 by mechanical means (not shown), such as bolts, cables or the like.

Figure 2:
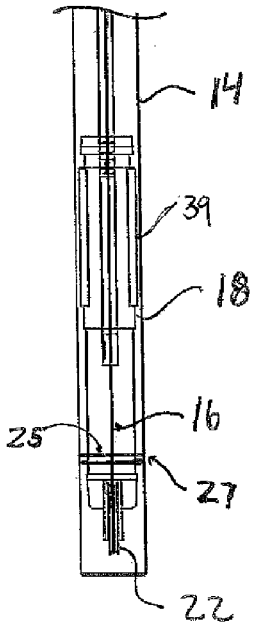
FIG. 2 is an elevation view and partly cut-away drawing of a lower portion of the retractable mousehole according to the invention, in an unlocked state.
Figure 3:
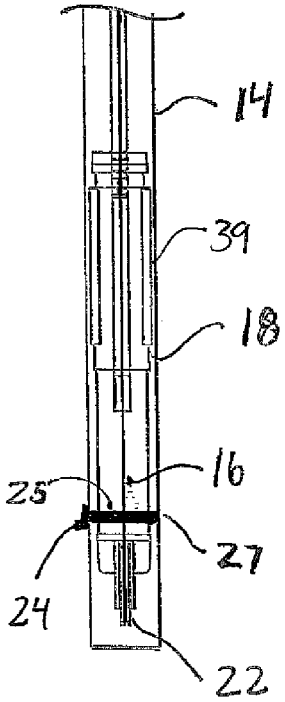
FIG. 3 is a similar drawing to that of FIG. 2, but illustrates a locked state of the mousehole.

Referring additionally to FIG. 2 and FIG. 3 (which are cut-away close-up views of the lower end of the mousehole tube, rotated 90° about the longitudinal axis compared to the view in FIG. 1), the elevating bottom comprises a through-hole 25, and the mousehole tube 14 comprises a corresponding through-hole 27. When a locking pin 24 (see FIG. 3) is inserted through the holes 25, 27, the elevating bottom 18 and the mousehole tube 14 are effectively interlocked. Although not shown, it should be understood that other interlocking means may be equally suitable.

Figure 4:
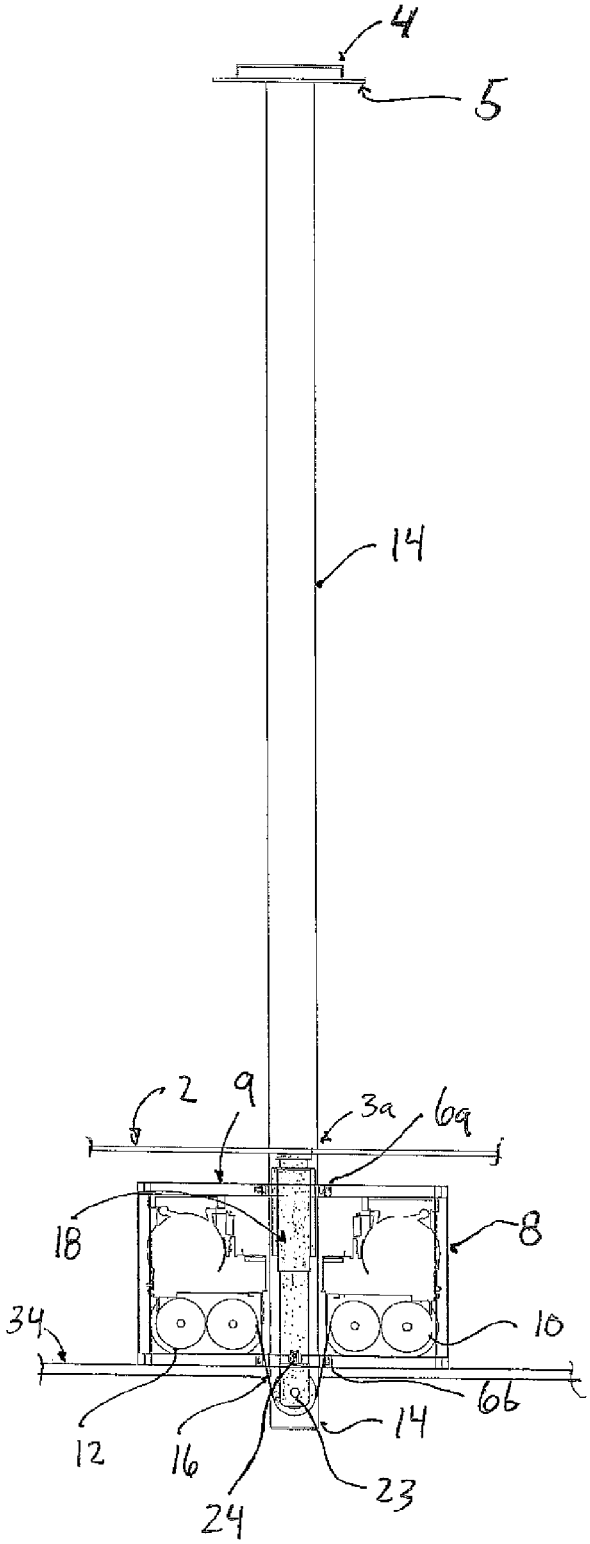
FIG. 4 is an elevation view and partly cut-away drawing of the retractable mousehole according to the invention, in a locked state and retracted from underneath the drill floor and extending up above the drill floor.

When the elevating bottom 18 and the mousehole tube 14 are interlocked (and, if applicable, the optional fastening between the mousehole tube and the cellar deck has been released), and the winch 10 and (optionally) the second winch 12 is (are) operated to reel in the cable 16, the entire mousehole tube 14 is pulled up through the deck frame 8, and thus retracted away from the cellar deck 26. FIG. 4 illustrates how the mousehole tube 14 has been pulled in almost entirely; the drill floor opening 3*a* is open, and the mousehole tube extends up above the drill floor 2. In this position, the mousehole tube is suspended by the cable 16, but an additional support may be provided by a mechanical interface with the drill floor (not shown).

Figure 5:
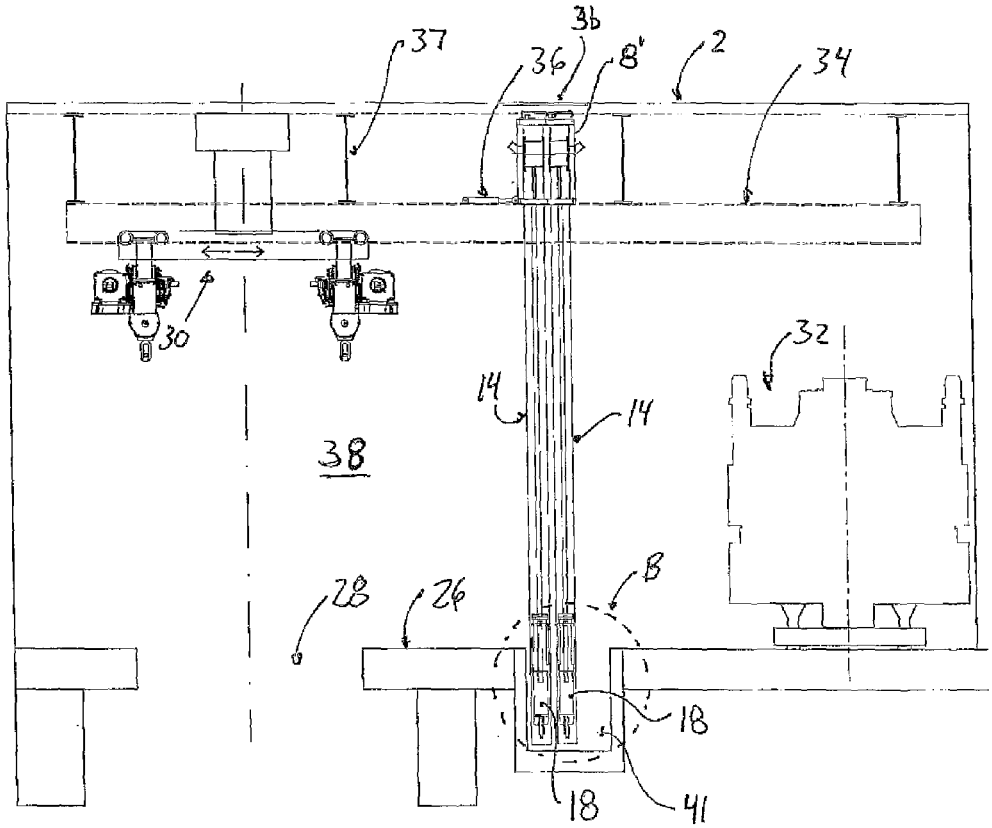
FIG. 5 illustrates an assembly of two mouseholes according to the invention, the mouseholes being in a working mode, unlocked and extending into the region between the drill floor deck and a cellar deck.

FIG. 5 shows two mousehole installed on a drilling vessel. The mechanical principles and operational methods are similar to those discussed above (necessary power supply cables, hydraulics, etc., have been omitted from the drawings, as these are well known in the art), and it should be understood that even more mousehole apparatuses may be assembled together. Reference number 8' denotes a compounded deck frame or and interconnected deck frames 8.

The deck frame is supported on skid beams 34, which are connected to the rig structure via bulkheads 37. The deck frame is movable along the beams by actuation of one or more skidding cylinders 36. The skid beams 34 may also provide support for an overhead crane 30 which is used for moving equipment 32 around on the cellar deck 26, for example into and out of the moon pool 28.

Figure 6:
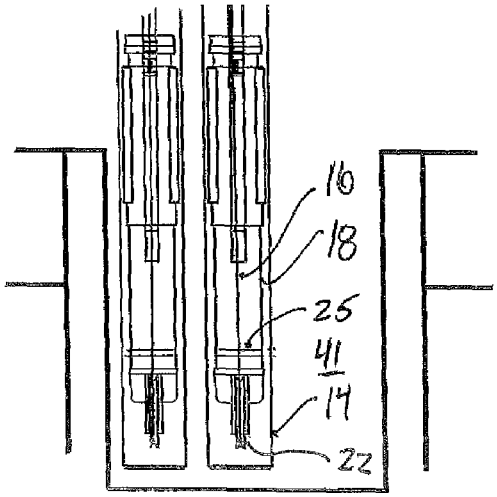
FIG. 6 is an enlargement of the portion labelled "B" in FIG. 5.

Thus, FIGS. 5 and 6 show the mousehole apparatus in a working position, i.e. each tube 14 is suspended by the upper collar 5 (see FIG. 1), and the elevating bottom ("rabbit") 18 and the mousehole tube 14 are not interconnected. In this mode, the mousehole, and the rabbit, are operated in a fashion which per se is known. The lower end of the mousehole tubes extend into a well 41 on the cellar deck, this well serving as a safety receptacle for objects that may fall out of the mousehole. As mentioned above, the lower part of each mousehole tube 14 is conveniently fastened to the cellar deck 26 (e.g. in the well 41) by mechanical bolts, cables or the like when the mousehole apparatus is in the working position.

Figure 7:
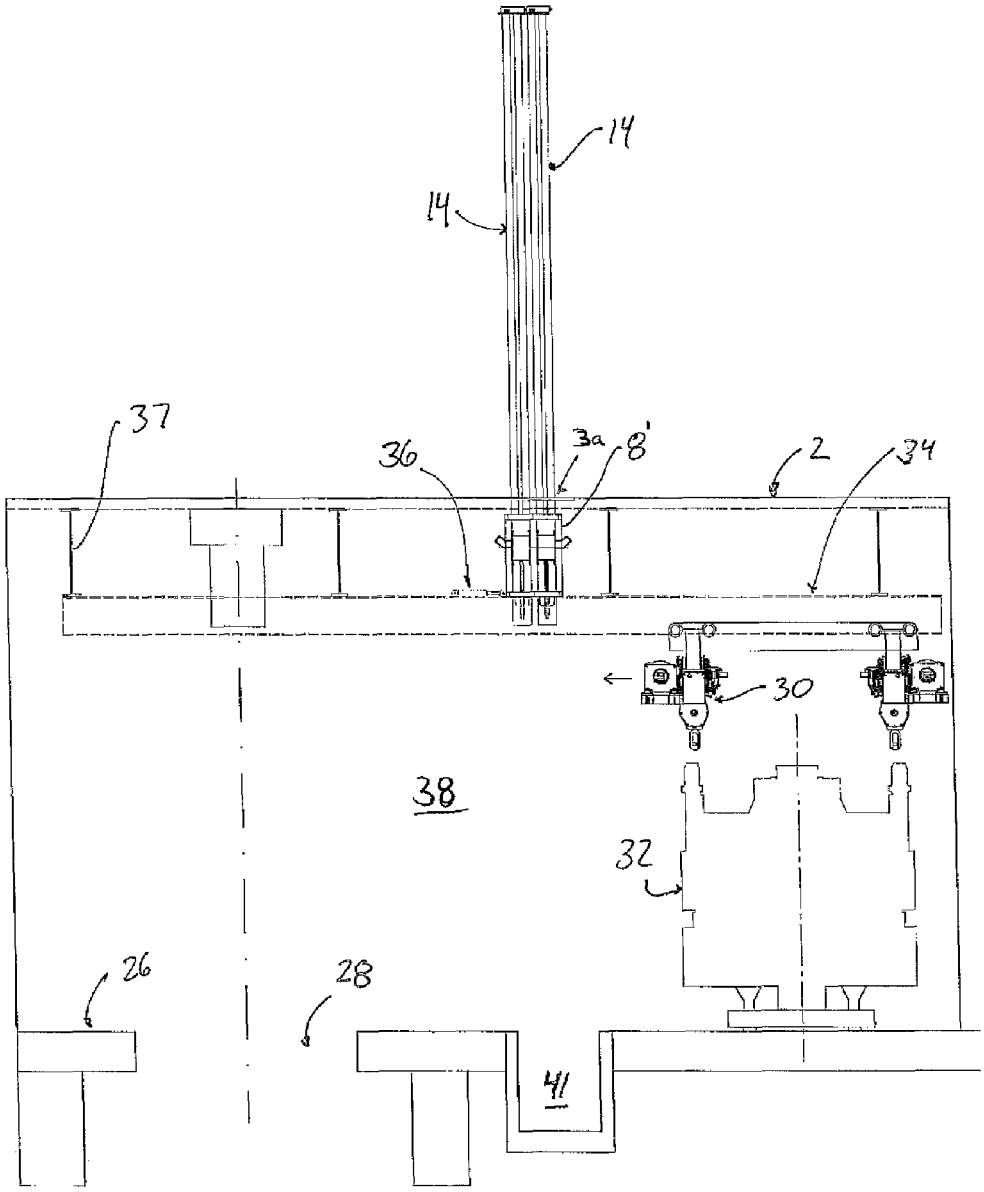
FIG. 7 illustrates the same configuration as FIG. 5, but shows the mouseholes in a locked state and retraced from the region between the drill floor deck and a cellar deck.

When the mousehole apparatus is not in use, it may be retracted away from the cellar deck compartment 38, freeing up space on the cellar deck and allowing unimpeded movement of the overhead crane. This situation is shown in FIG. 7, where the rabbit 18 and the mousehole tube 14 have been interlocked as described above with reference to FIG. 3. Both mousehole tubes may thus be fully retracted, and equipment may be moved on the cellar deck.

In the working position (standbuilding mode of operation), the mousehole apparatus is conveniently controlled from the driller's cabin (not shown), assisted by information provided by instrumentation (not shown) such as electronic load cell on the cable, proximity sensor for centralizer, position sensor for winch, and position sensor for skidding cylinder.

The sequence for retracting the mousehole tube(s) may be summarised as:

1. Skid deck frame 8; 8' to correct position for retraction of tube(s) 14;

2. Remove drill floor protection cover 3*b;*

3. Disconnect hydraulic lines (not shown) to the centralizer 4;

4. Close off area on drill floor 2 where mousehole opening (s) 3*a* is(are);

5. From driller's cabin, run rabbit 18 to lower position in tube 14 (For safety reasons, this is an "override" function that requires a code or a special permit);

6. Interlock rabbit 18 and mousehole tube 14;

7. Activate winch(es) 10 (12) and run "rabbit up" function in order to retract mousehole tube(s) from cellar deck 26 and elevate the tube(s) up through opening 3*a*, guided by upper and lower guides 6*a,b* in deck frame;

8. Insert safety pin at drill floor level.

This sequence is reversed when the mousehole apparatus is to be lowered back into the cellar deck area.

The invention claimed is:

1. A mousehole apparatus, comprising:

a main body configured for holding a drill pipe or similar elongate element, said main body comprising:

an elongate tubular element having an interaction member; and a support device movably arranged within the elongate tubular element and being operable to be moved up and down in the elongate tubular element, the interaction member being connected to the support device for the drill pipe or similar elongate element;

a locking device configured to interlock the support device and the elongate tubular element; and a carrier connected to a deck structure and having a support region adapted for releasable supportive interaction with an abutment element on the main body, the carrier comprising:

guiding devices for the main body; and a movement device operable to move the main body with respect to the carrier, said movement device comprising a first winch arranged on the carrier; and a cable extending from the first winch, via the interaction member and back to a second winch or a fixture on the carrier, said movement device being connected to the interaction member of the main body and being operable to move at least a portion of the main body from one side below the carrier to an opposite top side of the carrier, wherein the support device is releasably fixed to the elongate tubular element via the locking device, and the elongate tubular element is operable to be moved up and down with respect to the carrier by operating the movement device.

2. The mousehole apparatus of claim 1, wherein the interaction member is a cable sheave.

3. The mousehole apparatus of claim 1, wherein the carrier is movably arranged on the deck structure, which is connected to and arranged below a drill floor.

4. The mousehole apparatus of claim 1, further comprising a compounded carrier supporting and controlling a plurality of main bodies.

5. A method of operating one or more mousehole apparatuses according to claim 1 on a drilling vessel having a drill floor and a cellar deck arranged a distance below the drill floor, thus defining a cellar compartment there between, said method comprising the step of selectively moving the main body between a mousehole working position, in which the main body extends into the cellar compartment, and a mousehole inactive position, in which the main body is retracted from the cellar compartment.

6. The method of claim 5, further comprising the steps of, when in the mousehole working position, suspending the main body from a carrier and ensuring that the support device is movable within the main body.

7. The method of claim 5, wherein, to bring the mousehole to an inactive position, further comprising the steps of locking the support device to the main body, and activating the movement device to retract the main body out of the cellar compartment.

8. A drilling vessel having a drill floor and a cellar deck arranged a distance below the drill floor, thus defining a cellar compartment there between, wherein one or more of the mousehole apparatuses of claim 1 are arranged on a deck structure which is arranged underneath, and connected to, the drill floor, and wherein the main body is movable between an extended position into the cellar compartment, and a retracted position where the main body is retracted from the cellar compartment.

9. The mousehole apparatus of claim 2, wherein the carrier is movably arranged on the deck structure, which is connected to and arranged below a drill floor.

10. The mousehole apparatus of claim 2, wherein the carrier is movably arranged on the deck structure, which is connected to and arranged below a drill floor.

11. The mousehole apparatus of claim 2, wherein the carrier is movably arranged on the deck structure, which is connected to and arranged below a drill floor.

12. The mousehole apparatus of claim 2, further comprising a compounded carrier supporting and controlling a plurality of main bodies.

13. The mousehole apparatus of claim 2, further comprising a compounded carrier supporting and controlling a plurality of main bodies.

14. The mousehole apparatus of claim 2, further comprising a compounded carrier supporting and controlling a plurality of main bodies.

15. The mousehole apparatus of claim 3, further comprising a compounded carrier supporting and controlling a plurality of main bodies.

* * * * *